US008446650B2

(12) United States Patent
Uchida et al.

(10) Patent No.: US 8,446,650 B2
(45) Date of Patent: May 21, 2013

(54) DOCUMENT CONVEYING DEVICE AND DOCUMENT READING APPARATUS THE SAME

(75) Inventors: Toru Uchida, Kakegawa (JP); Yasukazu Nagura, Kakegawa (JP); Atsushi Uematsu, Kakegawa (JP)

(73) Assignee: NEC Access Technica, Ltd., Shizuoka (JP)

( * ) Notice: Subject to any disclaimer, the term of this patent is extended or adjusted under 35 U.S.C. 154(b) by 449 days.

(21) Appl. No.: 12/772,727

(22) Filed: May 3, 2010

(65) Prior Publication Data

US 2010/0328738 A1 Dec. 30, 2010

(30) Foreign Application Priority Data

Jun. 29, 2009 (JP) ..... 2009-153129

(51) Int. Cl.
*H04N 1/04* (2006.01)

(52) U.S. Cl.
USPC ..... 358/498; 358/474; 358/501; 271/264

(58) Field of Classification Search
USPC ..... 358/474, 498, 496, 501; 271/264
See application file for complete search history.

(56) References Cited

U.S. PATENT DOCUMENTS

| | | | | | |
|---|---|---|---|---|---|
| 2,903,512 | A * | 9/1959 | Buckingham | 358/496 |
| 5,224,698 | A * | 7/1993 | Kobayashi | 271/270 |
| 5,398,097 | A * | 3/1995 | Satoh et al. | 399/111 |
| 5,668,681 | A * | 9/1997 | Umezawa | 360/96.4 |
| 6,010,072 | A * | 1/2000 | Matsumoto et al. | 235/472.01 |
| 6,456,807 | B1 * | 9/2002 | Makino et al. | 399/167 |
| 6,595,517 | B1 | 7/2003 | Tranquilla | |
| 2007/0025768 | A1 | 2/2007 | Komatsu et al. | |

FOREIGN PATENT DOCUMENTS

| | | | |
|---|---|---|---|
| JP | 55-65965 | A | 5/1980 |
| JP | 4292350 | A | 10/1992 |
| JP | 5-128717 | A | 5/1993 |
| JP | 2002-196791 | A | 7/2002 |
| JP | 2002-345204 | A | 11/2002 |
| JP | 2004-037965 | A | 2/2004 |
| JP | 2004-051365 | A | 2/2004 |
| JP | 2004050686 | A | 2/2004 |
| JP | 2005-86494 | A | 3/2005 |
| JP | 2005-289544 | A | 10/2005 |

OTHER PUBLICATIONS

Search Report dated Sep. 14, 2011 from the European Patent Office in counterpart application No. 10160170.6.

* cited by examiner

*Primary Examiner* — Negussie Worku
(74) *Attorney, Agent, or Firm* — Sughrue Mion, PLLC

(57) ABSTRACT

A document conveying device, include a conveyance roller which conveys a document that is attached to a conveyance roller shaft; and a flywheel connected to the conveyance roller shaft.

15 Claims, 9 Drawing Sheets

Fig.7A
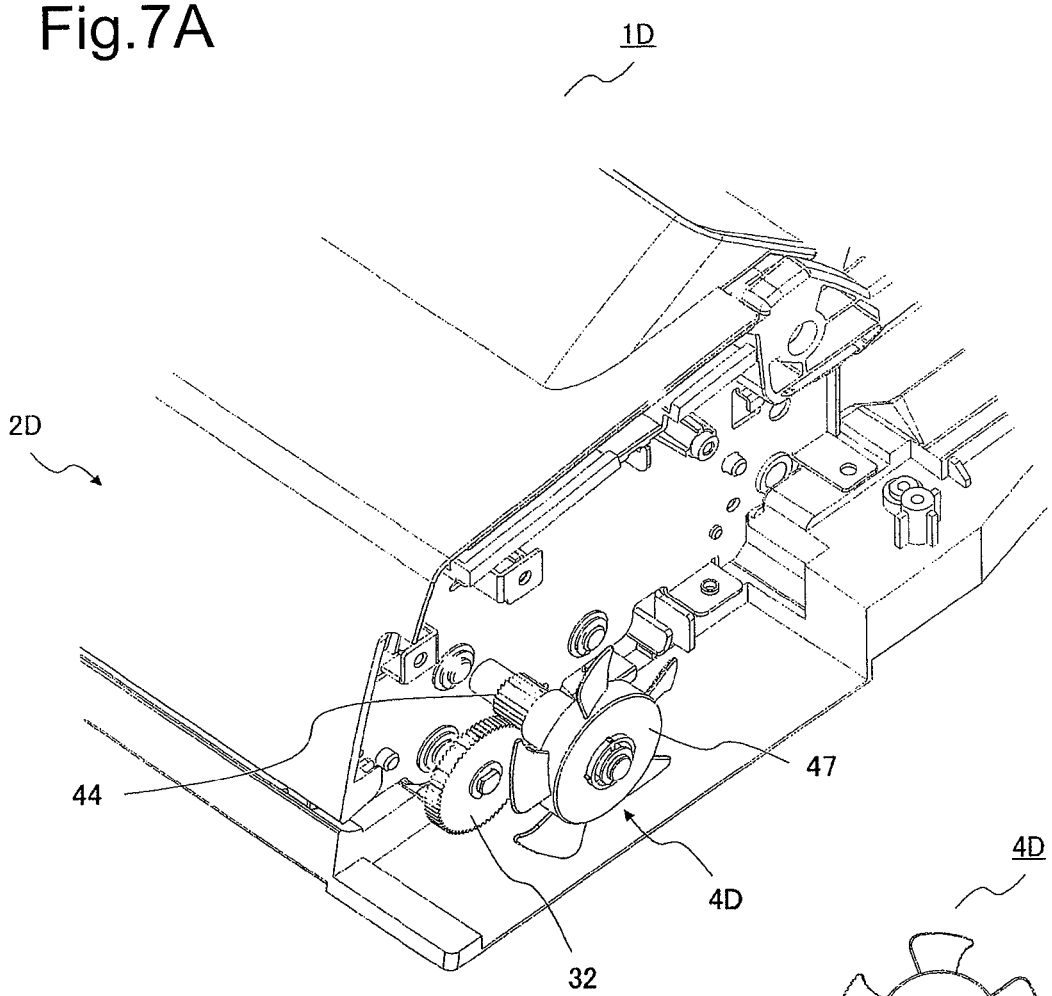
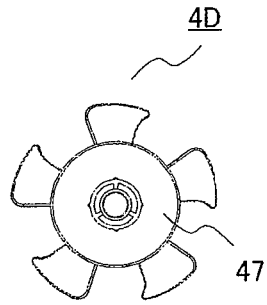
Fig.7B

DOCUMENT CONVEYING DEVICE AND DOCUMENT READING APPARATUS THE SAME

This application is based upon and claims the benefit of priority from Japanese Patent Application No. 2009-153129, filed on Jun. 29, 2009, the disclosure of which is incorporated herein in its entirety by reference.

TECHNICAL FIELD

The present invention relates to a document conveying device and a document reading apparatus using the document conveying device, and particularly relate to a sheet-through type document conveying device and a document reading apparatus using the document conveying device.

BACKGROUND ART

A document reading apparatus having a document conveying device is known. This document reading apparatus includes a document reading unit for reading information on a document that is conveyed. The document conveying device includes two conveyance rollers. One conveyance roller is disposed on a downstream side in a conveying direction when viewed from the document reading unit and the other conveyance roller is disposed on an upstream side in the conveying direction when viewed from the document reading unit.

Each conveyance roller is composed of a pair of rollers including an upper roller and a lower roller. The document is nipped between the opposing contact portion (nip portion) of the upper and lower rollers and conveyed by rotation of the conveyance roller.

A phenomenon in which a conveyance speed of the document changes when the end edge of the document passes through the nip portion of the conveyance roller located on the upstream side is known. To avoid this phenomenon, a method for preventing a change in speed and a method for reducing the amount of change in speed are proposed.

These methods are disclosed in patent documents, for example, the Japanese Patent Application Laid-Open No. 2005-289544, the Japanese Patent Application Laid-Open No. 2004-051365 and the Japanese Patent Application Laid-Open No. 2002-196791. In the methods disclosed in the above patent documents, a nip pressure is released or reduced before the end edge of the document passes through the nip portion.

In this method, a control circuit and an actuator are needed in order to release or reduce the nip pressure at an appropriate timing. When the control circuit and the actuator are used, the cost of the device increases and additionally, the energy consumption increases. Accordingly, it is desirable to employ a method which is simple and of low energy consumption.

The Japanese Patent Application Laid-Open No. 2004-037965 propose a document conveying device in which pressure release means is disposed and the nip pressure is released after a predetermined time has elapsed from nipping the document by the conveyance roller when the end edge of the document passes through the nip portion of the conveyance roller disposed on the upstream side of a document reading position.

However, in the structure of the invention disclosed in the Japanese Patent Application Laid-Open No. 2004-037965, means for measuring the predetermined time and means for releasing the nip pressure are additionally needed when the pressure release means is used. This causes an increase in the cost of the document conveying device.

FIG. 9A is a graph of a pushing force ratio that is a value obtained by normalizing a force to push a document by a nip pressure for each sheet thickness versus thickness of a sheet document. FIG. 9B is a graph of a calculated value of a pushing distance that is a distance over which a document is pushed versus thickness of a sheet document.

A horizontal axis in FIG. 9A and FIG. 9B represents a thickness of a sheet. The sheet thickness shown in FIG. 9A and FIG. 9B is a range of a thickness of a sheet conveyed by a general document reading apparatus.

In the calculation of the pushing force and the pushing distance, a usual value of the general document reading apparatus is used for a diameter of the conveyance roller or the like and the nip pressure is set to "1". Namely, it is observed from FIG. 9A and FIG. 9B that when the document having the sheet thickness of about 0.18 mm is conveyed, the document is pushed about 1.2 mm when the end edge of the document passes through the nip portion and a peak value of the pushing force ratio is a bit more than 30% of the nip pressure.

Namely, in an example shown in FIG. 9A and FIG. 9B, when the document is pushed over the pushing distance, the pushing force is continuously applied to the document and the conveyance speed continuously increases.

The change in the conveyance speed can be suppressed by controlling the rotation of the conveyance roller shaft. However, this method is not efficient for the following reason. When a brake is employed as a mechanism to control the rotation of the conveyance roller shaft, a size of the brake exceeds the practical range. This causes an increase in the cost of the document conveying device.

SUMMARY

A main purpose of the present invention is to provide a document conveying device whose structure is simple and in which a rapid change in an angular velocity of the conveyance roller shaft is suppressed and a document reading apparatus using the document conveying device.

A document conveying device, include a conveyance roller which conveys a document that is attached to a conveyance roller shaft; and a flywheel connected to the conveyance roller shaft.

BRIEF DESCRIPTION OF THE DRAWINGS

Exemplary features and advantages of the present invention will become apparent from the following detailed description when taken with the accompanying drawings in which:

FIG. 7A is a fragmentary perspective view of a document reading apparatus having a document conveying device according to a fourth exemplary embodiment of the present invention;

FIG. 7B is a front elevational view of a flywheel according to the fourth exemplary embodiment of the present invention.

EXEMPLARY EMBODIMENT

Next, a detailed explanation will be given for a first exemplary embodiment with reference to the drawings.

The document conveying device according to the present invention conveys one in a bundle of the documents stacked on a stacking tray, separately, one by one and puts it at a reading position. A document reading apparatus such as a one-dimensional scanner or the like is disposed at the reading position in a direction perpendicular to a conveying direction and an image of the document is read while conveying the document. Such conveying mechanism is called a sheet-through type document conveying device.

The document conveying device has conveyance roller shafts that are located at a downstream side and a upstream side of the reading position in the document conveying direction and rotate at substantially the same speed. The flywheel with inertia moment that is sufficiently larger than inertia moment of the conveyance roller is attached to the conveyance roller shaft located on the upstream side of the document reading position.

The work performed by the nip pressure is converted into a rotation energy of the conveyance roller and the rotation of the conveyance roller is accelerated. As a result, the conveyance speed of the document is increased. Accordingly, a change in conveyance speed is determined by the inertia moment of the conveyance roller and the nip pressure.

This indicates that when the inertia moment of the conveyance roller is too small compared with the nip pressure, the change in conveyance speed exceeds an allowable range.

Accordingly, in the present invention, the flywheel that is connected to the conveyance roller shaft via a speed increasing gear is provided, and whereby the speed change that occurs when the end edge of the document passes through the nip portion of the conveyance roller is suppressed within a practically usable range. As a result, in the document conveying device, the performance can be improved, the production cost can be reduced and the power consumption can be reduced.

First Exemplary Embodiment

Figure 1:
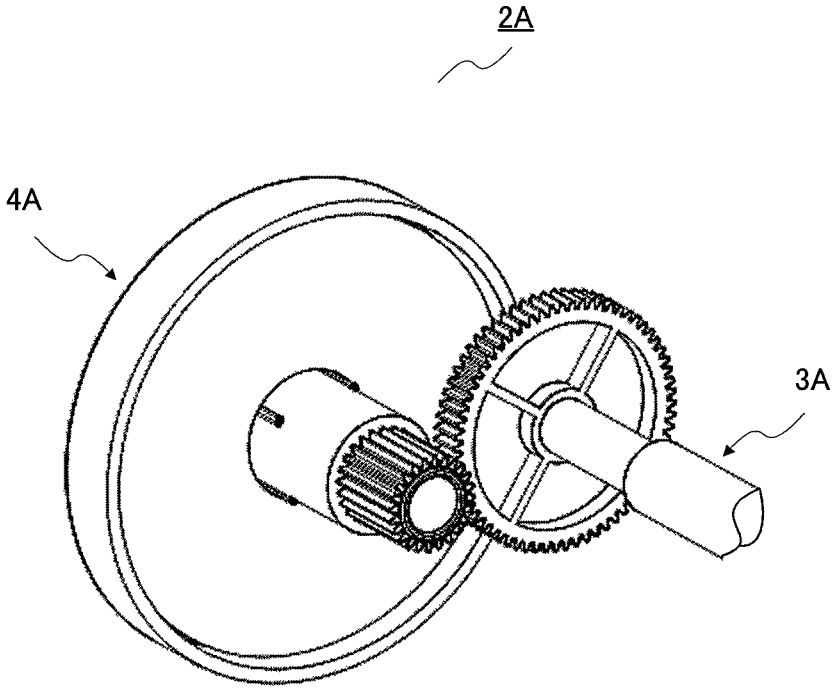
FIG. 1 is a fragmentary perspective view of a document conveying device according to a first exemplary embodiment of the present invention.

An exemplary embodiment of the present invention will be described. FIG. 1 is a fragmentary perspective view of a document conveying device 2A according to a first exemplary embodiment. This document conveying device 2A includes a conveyance roller 3A to convey the document which attached with a conveyance roller shaft, and a flywheel 4A connected to the conveyance roller shaft.

The flywheel 4A has a predetermined inertia moment. Accordingly, when an angular velocity of the conveyance roller is rapidly varied, the inertia moment of this flywheel 4A suppresses the change in the angular velocity of the conveyance roller 3A. Accordingly, the rapid change in the angular velocity of the conveyance roller 3A can be suppressed with a simple structure.

Second Exemplary Embodiment

Figure 2:
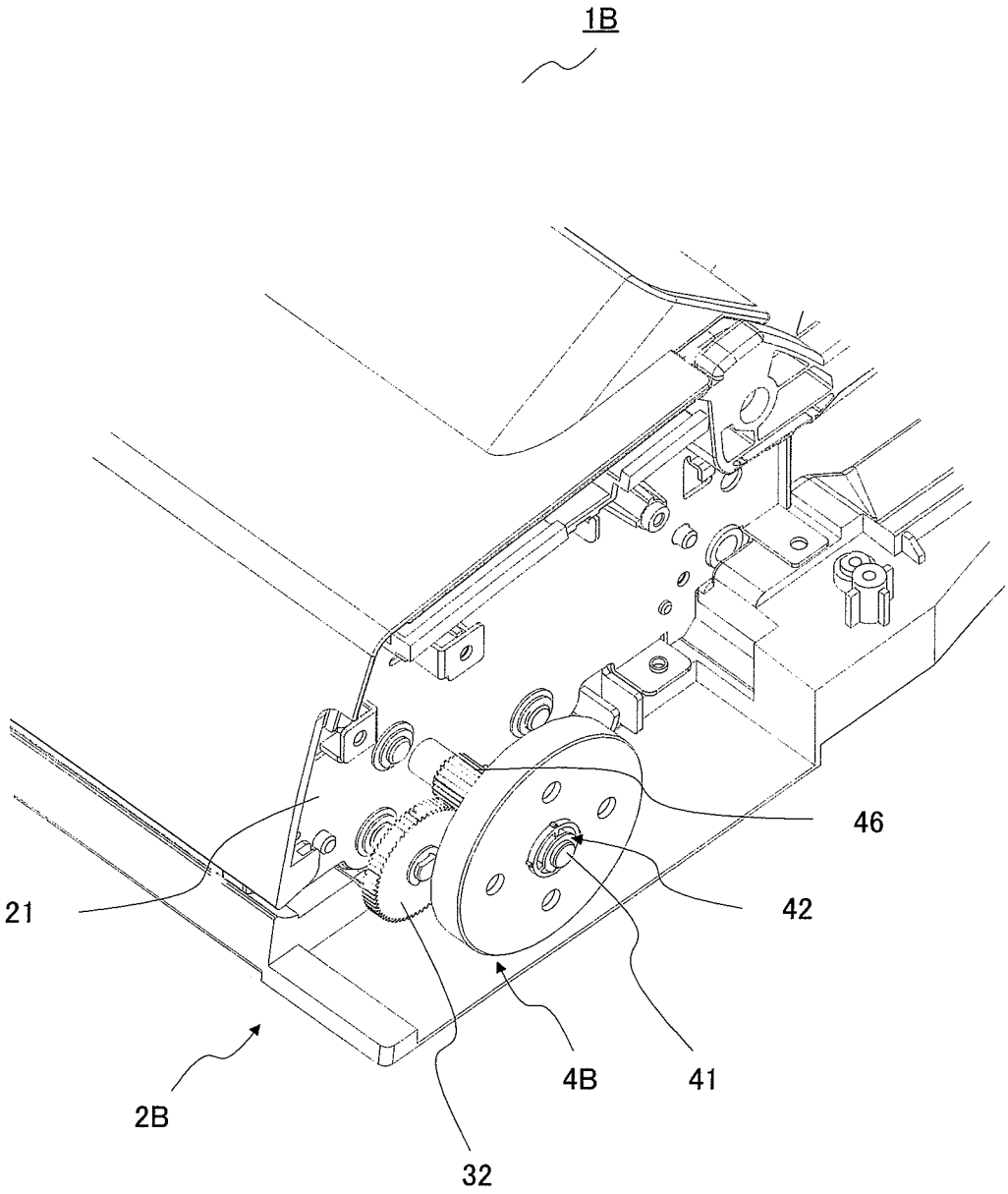
FIG. 2 is a fragmentary perspective view of a document reading apparatus having a document conveying device according to a second exemplary embodiment of the present invention.

A second exemplary embodiment of the present invention will be described. FIG. 2 is a fragmentary perspective view of a document reading apparatus 1B having a document conveying device 2B according to a second exemplary embodiment.

Figure 3:
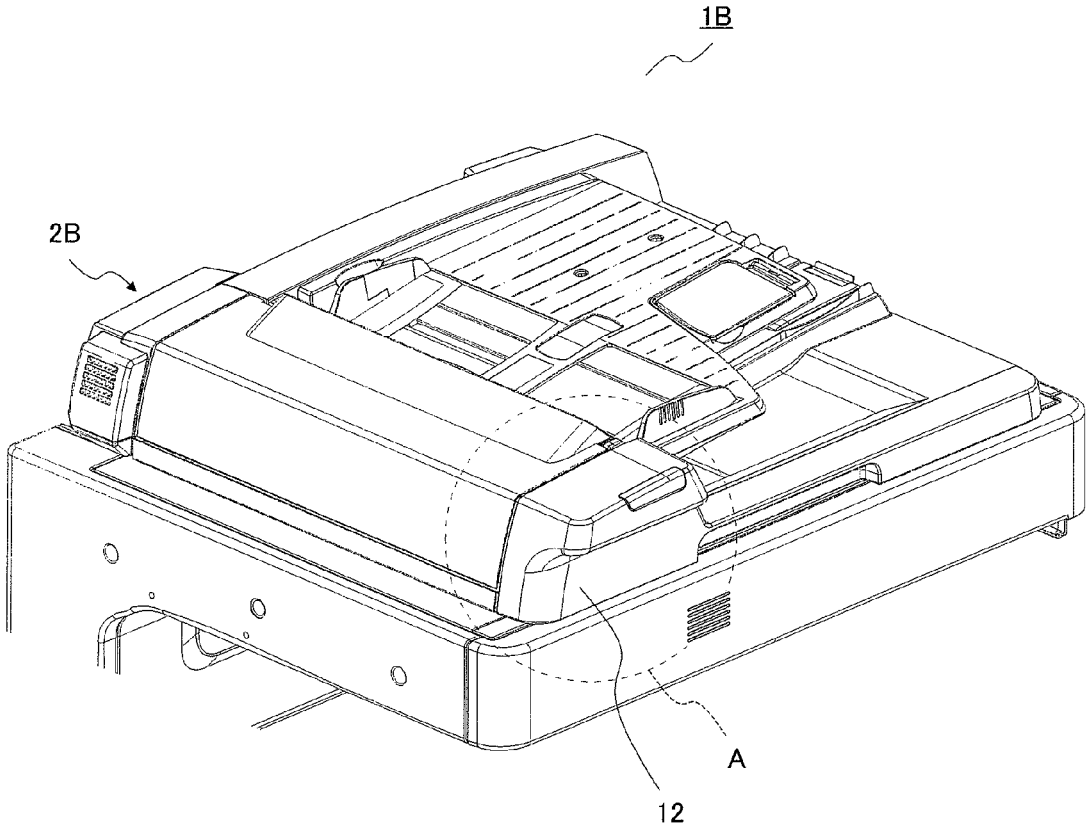
FIG. 3 is an external view of a document reading apparatus according to the second exemplary embodiment.
Figure 4:
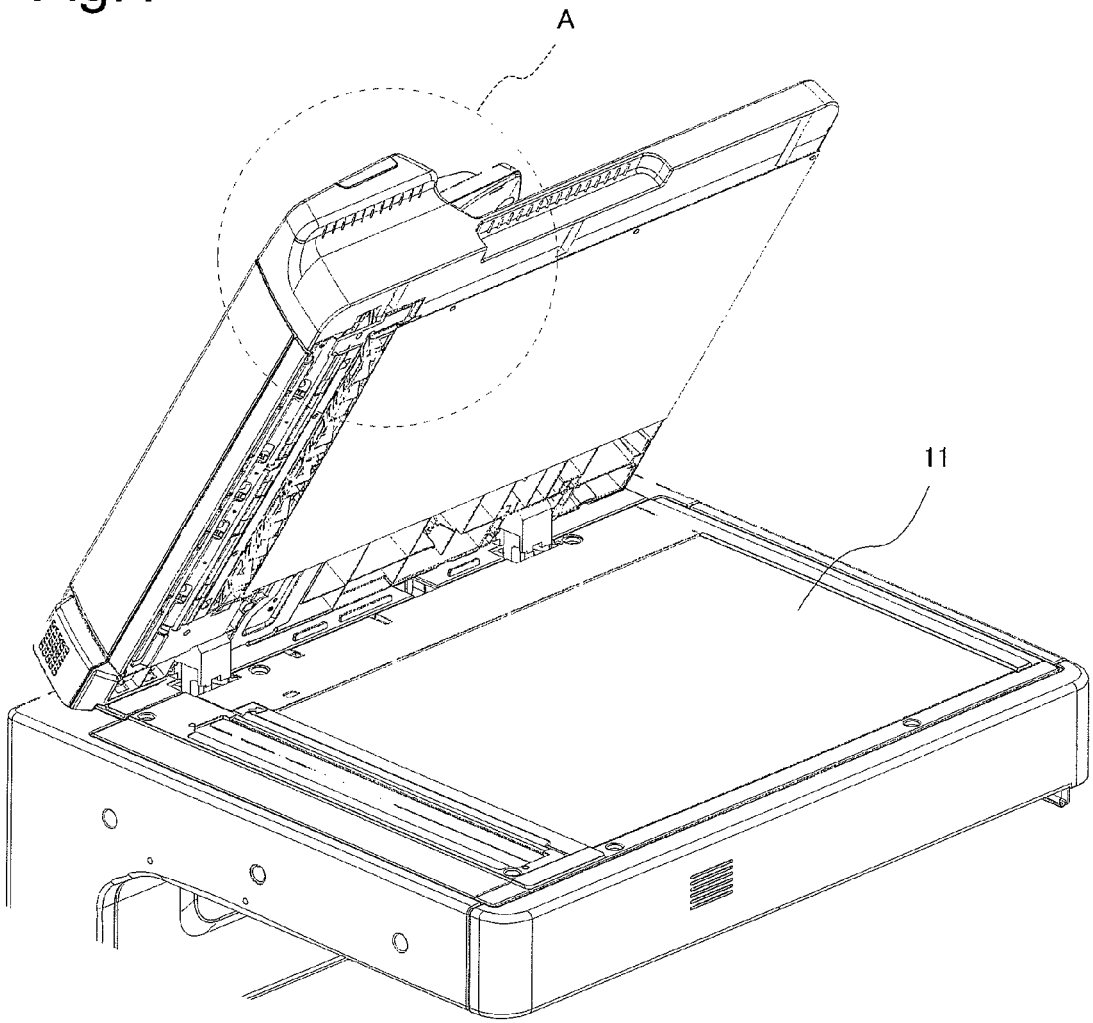
FIG. 4 is a fragmentary perspective view of a document reading apparatus in which the document conveying device according to the second exemplary embodiment is in a paper discharge state.

FIG. 3 is an external view of the document reading apparatus 1B and FIG. 4 is a perspective view of the document reading apparatus 1B in an state in which the front edge of the document conveying device 2B is lifted up to open it. Hereinafter, the state shown in FIG. 3 is described as a conveyance state and the state shown in FIG. 4 is described as a paper discharge state. Further, FIG. 2 is an enlarged view of an area A of the document reading apparatus 1B shown in FIG. 3 when a conveyance portion cover 12 is removed.

The document conveying device 2B has a flywheel 4B which is rotatably attached to a shaft 41 fixed to a chassis 21. An E-shape retaining ring 42 is provided to the shaft 41 so that the flywheel 4B is prevented from being removed from the shaft 41.

When the document is conveyed, the document conveying device 2B is set to the conveyance state as shown in FIG. 3. On the other hand, when the jammed document in a conveying path is removed, the document conveying device 2B is set to the paper discharge state as shown in FIG. 4. Further, in the paper discharge state, the document is put on a glass plate 11 and the document may be read without conveying it.

Figure 5B:
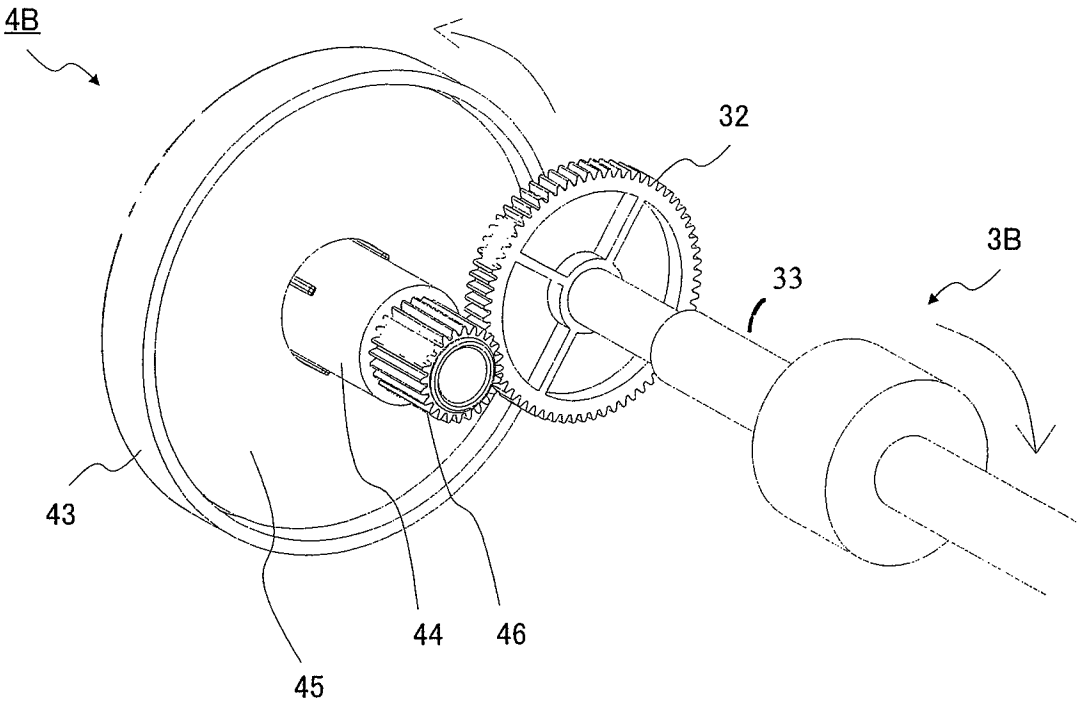
FIG. 5B is a fragmentary perspective view of a document conveying device according to the second exemplary embodiment.
Figure 5A:
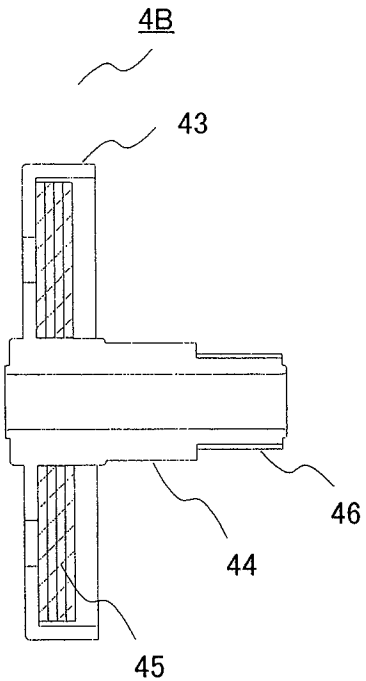
FIG. 5A is a sectional view of a flywheel according to the second exemplary embodiment.

FIG. 5A is a sectional view of the flywheel 4B and FIG. 5B is a perspective view of the flywheel 4B when viewed from a conveyance roller 3B side.

This flywheel 4B includes a flywheel cover 43, a flywheel shaft 44 integrally formed with the flywheel cover 43, an inertial load 45 fixed to the flywheel cover 43, and a small gear 46 that is formed or fixed to the flywheel shaft 44. A large gear 32 is fixed to the conveyance roller shaft 33. The "small" in the small gear 46 does not make the concrete diameter dimension of each gear 32,46, but they mean whether being relatively large or small compared with the partner's gear.

An arbitrary method such as welding, insert molding, screwing or the like can be applied as a method for coupling the flywheel cover 43 with the inertial load 45. However, it is desirable to apply a method with which no clearance is provided between the flywheel cover 43 and the inertial load 45, and it is desirable to reduce a backlash between the large gear 32 and the flywheel gear 44 as much as possible.

This is because when a gap exists between the flywheel gear 44 and the large gear 32, or a play exists between the conveyance roller shaft 33 and the large gear 32, a coupling between the conveyance roller shaft 33 and the flywheel 4B is temporarily released by the gap or the play. When the coupling between the conveyance roller shaft 33 and the flywheel 4B is released, the rapid speed change of the conveyance roller shaft 33 cannot be suppressed.

Accordingly, the document is easily inclined with respect to the conveying direction when the end edge of the document passes through the nip portion and a document jam easily occurs. In order to prevent such inconvenience, it is desirable to apply a method with which no clearance is provided between the flywheel covering 43 and the inertial load 45 as a method for coupling them.

The small gear 46 of the flywheel gear 4B engages with the large gear 32 of the conveyance roller shaft 33. Here, the number N1 of the teeth of the small gear 46 is set so as to be smaller than the number N2 of the teeth of the large gear 32 (N2>N1). In this exemplary embodiment, N1=24 and N2=66. As a result, when the flywheel 4B receives the rotational force from the conveyance roller shaft 33 and rotates, the flywheel 4B has to rotate at the angular velocity of γ times (γ=2.75=66/24).

Because the flywheel 4B has the inertial load 45, a large force is required for varying the angular velocity of the flywheel 4B. In other words, the flywheel 4B including the inertial load 45 has a large inertia moment.

Accordingly, the flywheel 4B acts as a generation source of a braking force against the change in the angular velocity of the conveyance roller 3B. In particular, when the inertia moment of the flywheel 4B including the inertial load 45 is I, because the gear ratio γ is 2.75, a force (I*γ) obtained by multiplying the inertia moment I by γ acts on the conveyance roller 3B.

Therefore, the change in the conveyance speed that occurs when the end edge of the document passes through the nip portion of the conveyance roller is suppressed and the document jam or the like generated by the change in the angular velocity of the conveyance roller shaft can be prevented.

This means that the performance of the document conveying device 2B and the document reading apparatus 1B using the same can be enhanced by using a simple structure without a large increase in cost. To suppress the change in the speed, the inertia moment which a member fundamentally has is used without using a mechanism such as an electric brake. Therefore, no additional electric power is consumed. This means that the energy saving is realized.

Third Exemplary Embodiment

Next, a third exemplary embodiment of the present invention will be described. Further, the same reference numbers are used for the same elements as the second exemplary embodiment and the description of the element will be omitted appropriately. In this exemplary embodiment, as shown in FIG. 6A and FIG. 6B, a flywheel 4C includes a cover having a dial shape. Further, the cover having a dial shape is a cover whose outer peripheral surface has a convexo-concave shape.

FIG. 6A is a fragmentary perspective view of a document reading apparatus 1C including a document conveying device 2C in which such flywheel 4C is used and FIG. 6B is a front elevational view of the flywheel 4C.

Figure 6C:
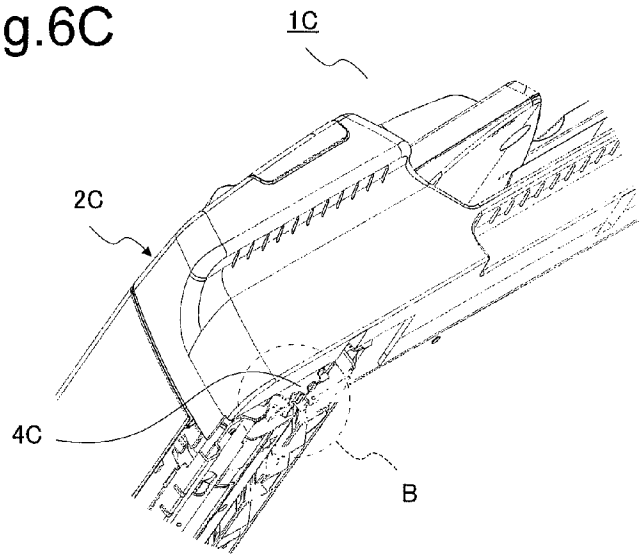
FIG. 6C is a fragmentary perspective view of a document reading apparatus in which the document conveying device according to the third exemplary embodiment is in a paper discharge state.
Figure 6D:
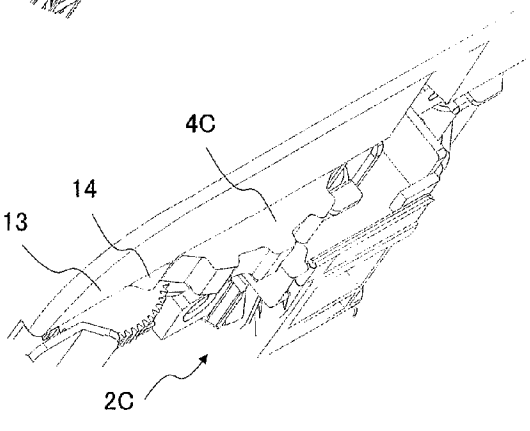
FIG. 6D is an enlarged view of an area B shown in FIG. 6C according to the third exemplary embodiment.
Figure 6A:
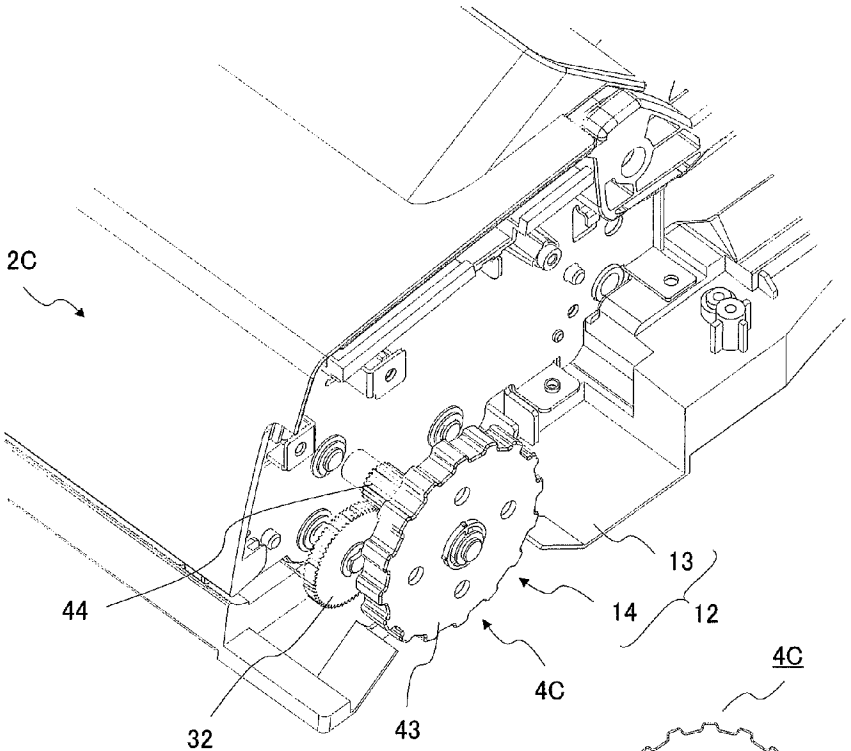
FIG. 6A is a fragmentary perspective view of a document reading apparatus according to a third exemplary embodiment.
Figure 6B:
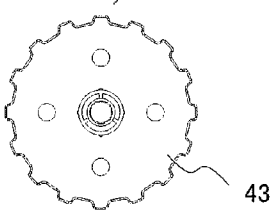
FIG. 6B is a front elevational view of a flywheel according to the third exemplary embodiment.

FIG. 6C is a perspective view of a document reading apparatus 1C in which the document conveying device 2C is in a paper discharge state and FIG. 6D is an enlarged view of an area B in FIG. 6C.

The flywheel 4C has the flywheel cover 43 having a dial shape and an opening 14 is provided in a bottom plate 13 of the conveyance portion cover 12 of the document conveying device 2C (refer to FIG. 6C and FIG. 6D). A part of the flywheel 4C is projected from the opening 14. Whereby, a user can rotate the flywheel 4C.

When the document jam occurs in the conveying path, the user rotates the flywheel 4C that is projected from the opening 14 to remove the jammed document. Because the flywheel 4C is connected to the conveyance roller shaft 33 via the flywheel gear 44 and the large gear 32, the document jammed to the conveyance roller shaft 33 and/or the conveyance roller 3B can be fed. In addition, because the number N1 of the teeth of the flywheel gear 44 is smaller than the number N2 of the teeth of the large gear 32 (N2>N1), the flywheel 4C can be rotated by a small force. Namely, the document can be easily fed.

Fourth Exemplary Embodiment

Next, a fourth exemplary embodiment of the present invention will be described. Further, the same reference numbers are used for the same elements as the second exemplary embodiment and the description of the element will be omitted appropriately. FIG. 7A is a fragmentary perspective view of a document reading apparatus 1D having a document conveying device 2D, and FIG. 7B is a front elevational view of a flywheel 4D. The flywheel 4D included in the document conveying device 2D has a flywheel cover 47 formed in a fin shape.

When the flywheel cover 47 having a fin shape rotates, the surrounding air is stirred. Accordingly, this exemplary embodiment has advantages in which a heat generating component (not shown) arranged in the vicinity of the flywheel cover 47 is cooled and an energy of the accelerated flywheel 4D is rapidly consumed. Further, the heat generating component arranged in the vicinity of the flywheel cover 47 is for example, a motor, an electromagnetic clutch, a solenoid, or the like.

Fifth Exemplary Embodiment

Next, a fifth exemplary embodiment of the present invention will be described. Further, the same reference numbers are used for the same elements as the second exemplary embodiment and the description of the element will be omitted appropriately.

Figure 8:
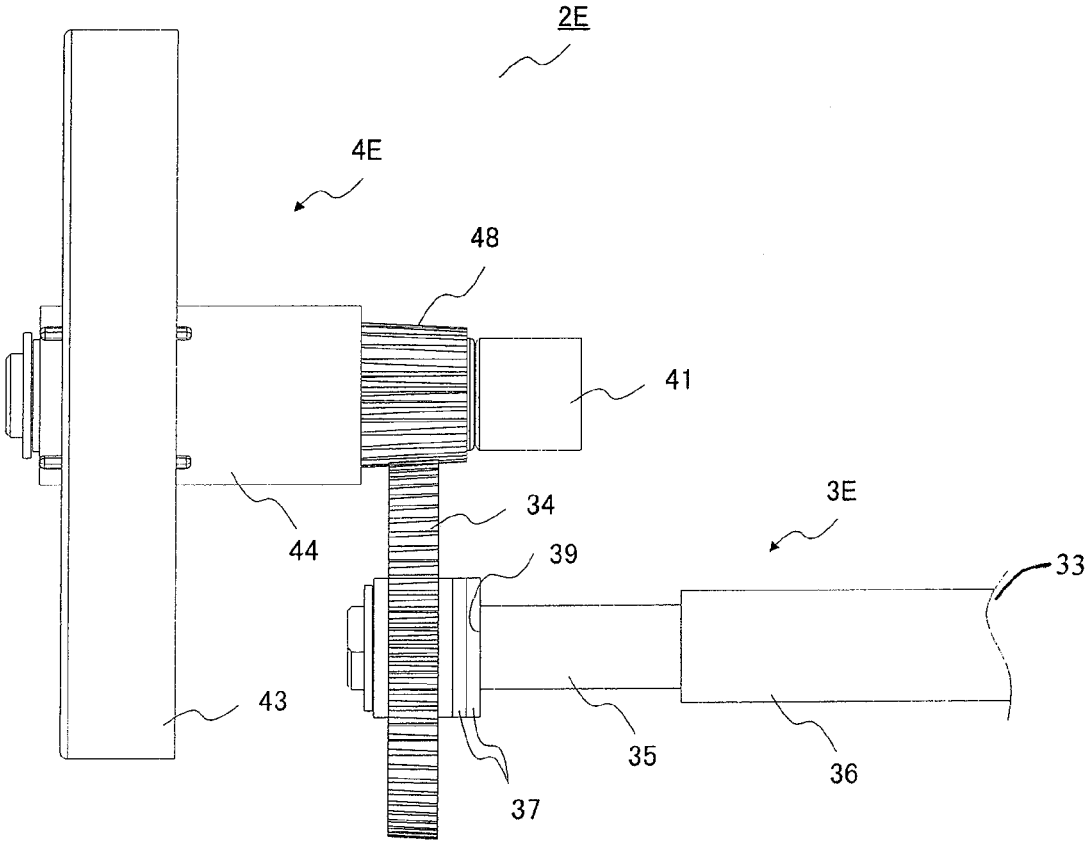
FIG. 8 is a fragmentary top view of a document conveying device according to a fifth exemplary embodiment of the present invention.
Figure 9A:
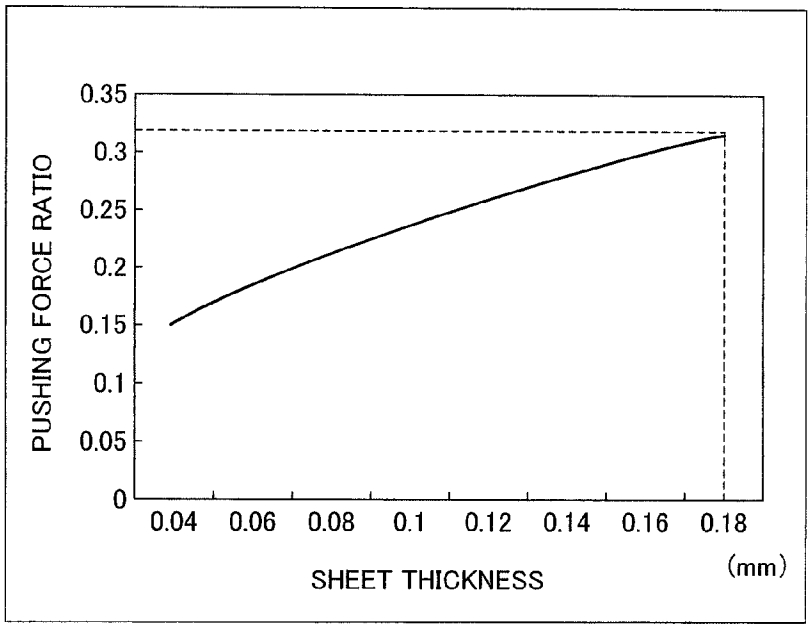
FIG. 9A is a graph of a pushing force ratio that is a value obtained by normalizing a force to push a document by a nip pressure for each sheet thickness versus thickness of a sheet document according to related art.
Figure 9B:
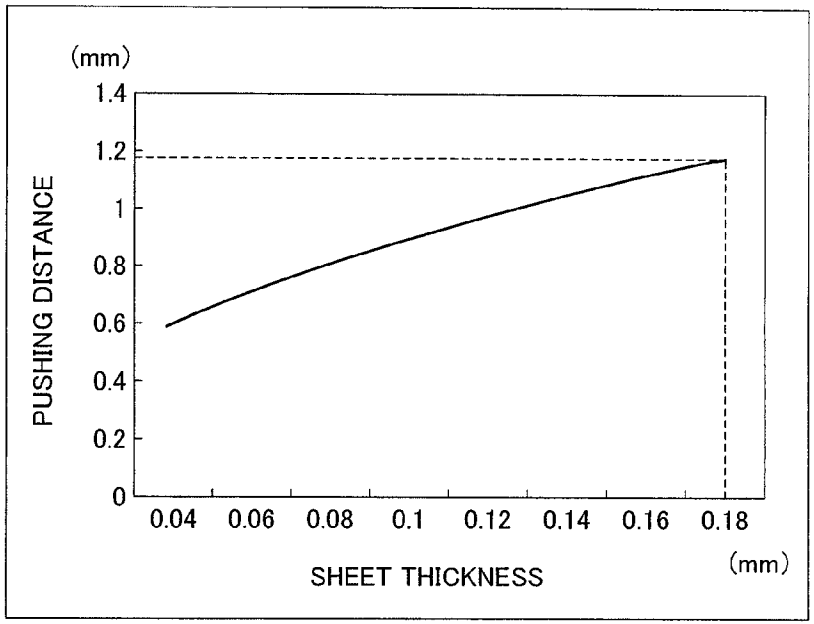
FIG. 9B is a graph of a calculated value of a pushing distance that is a distance over which a document is pushed versus thickness of a sheet document according to related art.

FIG. 8 is a fragmentary side view of a document conveying device 2E according to the fifth exemplary embodiment of the present invention. A small gear 48 connected to the flywheel shaft 44 of a flywheel 4E and a large gear 34 attached to a conveyance roller shaft 33 in the document conveying device 2E are tapered gears.

The conveyance roller shaft 33 includes a small diameter part 35 and a large diameter part 36. A spacer 37, the large gear 34, an E-shape ring 38 and the like are attached to the small diameter part 35. Further, the E-shape ring 38 has an elastic force which pushes the large gear 34 in an axial direction of the conveyance roller shaft 33.

A step portion 39 is formed at the boundary between the large diameter part 36 and the small diameter part 35.

The insertion of the spacer 37 is limited by the step portion 39, and the insertion of the large gear 34 is limited by the spacer 37. The spacer 37 is a washer-like member having a predetermined thickness. The large gear 34 is set to a predetermined position by adjusting the number of the spacers 37 that are used. Namely, the position of the large gear 34 is changed by adjusting the number of the spacers 37 that are used along the axis of the conveyance roller shaft 33. Accordingly, the position of the large gear 34 is set so that no backlash is obtained by adjusting the number of the spacers 37 that are used when the large gear 34 meshes with the small gear 46.

Further, the backlash between the small gear 46 and the large gear 34 may be suppressed by using a scissors gear for at least one of the small gear 46 and the large gear 34.

This exemplary embodiment has a structure in which the flywheel 4D is driven via the conveyance roller shaft 33. However, the flywheel 4D may be disposed on a driving force transmission path.

In this case, if the gear is provided between the flywheel 4D and the conveyance roller shaft 33, means for suppressing the backlash becomes complicated. Therefore, it is desirable to dispose the flywheel 4D at a position at which the flywheel 4D meshes with the conveyance roller shaft 33.

The document conveying device according to the present invention can also be applied to a device such as a laser recording device, an ink-jet recording device, or the like in which a thick sheet material has to be precisely conveyed by a pressing roller in addition to the document reading apparatus.

The document conveying device according to the present invention is a sheet-through type document conveying device which conveys one in a bundle of the documents stacked on a stacking tray, separately, one by one, puts it at a reading position, and reads the document one-dimensionally at the reading position in a direction perpendicular to the conveying direction while conveying the document. In the document conveying device, a mechanism including the conveyance rollers that are located in front of and behind the reading position in the document conveying direction and rotate at substantially the same speed is included, the flywheel with inertia moment that is sufficiently larger than inertia moment of the conveyance roller is attached to the conveyance roller shaft located on the upstream side of the document reading position among the conveyance rollers, the flywheel has a dial shape and the flywheel is arranged at a position at which a user can access the flywheel.

The document reading apparatus according to the present invention is a sheet-through type document reading apparatus which conveys one in a bundle of the documents stacked on a stacking tray, separately, one by one, puts it at a reading position, and reads the document one-dimensionally at the reading position in a direction perpendicular to the conveying direction while conveying the document. In the document reading apparatus, a mechanism including the conveyance rollers that are located in front of and behind the reading position in the document conveying direction and rotate at substantially the same speed is included, the flywheel with inertia moment that is sufficiently larger than inertia moment of the conveyance roller is attached to the conveyance roller shaft located on the upstream side of the document reading position among the conveyance rollers, the flywheel has a dial shape and the flywheel is arranged at a position at which a user can access the flywheel.

The present invention has the structure mentioned above. Therefore, the present invention has advantages in which the performance can be improved, the production cost can be reduced, the performance can be enhanced and the power consumption can be reduced.

The previous description of embodiments is provided to enable a person skilled in the art to make and use the present invention. Moreover, various modifications to these exemplary embodiments will be readily apparent to those skilled in the art, and the generic principles and specific examples defined herein may be applied to other embodiments without the use of inventive faculty. Therefore, the present invention is not intended to be limited to the exemplary embodiments described herein but is to be accorded the widest scope as defined by the limitations of the claims and equivalents.

Further, it is noted that the inventor's intent is to retain all equivalents of the claimed invention even if the claims are amended during prosecution.

The whole or part of the exemplary embodiments disclosed above can be described as, but not limited to, the following supplementary notes.

Supplementary note 1. A document conveying device, comprising:

a conveyance roller which conveys a document that is attached to a conveyance roller shaft; and a flywheel connected to the conveyance roller shaft.

Supplementary note 2. The document conveying device according to supplementary note 1, further comprising:

a flywheel gear attached to the flywheel; and a conveyance roller shaft gear that is attached to the conveyance roller shaft and engages with the flywheel gear, wherein the number of the teeth of the conveyance roller shaft gear is greater than the number of the teeth of the flywheel gear.

Supplementary note 3. The document conveying device according to supplementary note 1, wherein inertia moment of the flywheel is larger than the inertia moment of the conveyance roller.

Supplementary note 4. The document conveying device according to supplementary note 2, wherein the flywheel gear and the conveyance roller shaft gear are tapered gears.

Supplementary note 5. The document conveying device according to supplementary note 2, wherein the flywheel gear and the conveyance roller shaft gear are scissors gears.

Supplementary note 6. The document conveying device according to supplementary note 1, further comprising:

a load mechanism which consumes a rotational energy of the flywheel.

Supplementary note 7. The document conveying device according to supplementary note 6, wherein the load mechanism is a fin for stirring the surrounding air.

Supplementary note 8. The document conveying device according to supplementary note 1, wherein the flywheel has a cover having a dial shape.

Supplementary note 9. A document reading apparatus, comprising:

a document conveying device which includes a conveyance roller which conveys a document that is attached to a conveyance roller shaft and a flywheel connected to the conveyance roller shaft; and a reading device which reads the conveyed document.

Supplementary note 10. The document reading apparatus according to supplementary note 9, wherein the document conveying device further comprising:

a flywheel gear attached to the flywheel; and a conveyance roller shaft gear that is attached to the conveyance roller shaft and engages with the flywheel gear, wherein the number of the teeth of the conveyance roller shaft gear is greater than the number of the teeth of the flywheel gear.

Supplementary note 11. The document reading apparatus according to supplementary note 10, wherein the inertia moment of the flywheel is larger than the inertia moment of the conveyance roller.

Supplementary note 12. The document reading apparatus according to supplementary note 10, wherein the flywheel gear and the conveyance roller shaft gear are tapered gears.

Supplementary note 13. The document reading apparatus according to supplementary note 10, wherein the flywheel gear and the conveyance roller shaft gear are scissors gears.

Supplementary note 14. The document reading apparatus according to supplementary note 9, further comprising:

a load mechanism which consumes a rotational energy of the flywheel.

Supplementary note 15. The document reading apparatus according to supplementary note 14, wherein the load mechanism is a fin for stirring the surrounding air.

Supplementary note 16. The document reading apparatus according to supplementary note 9, wherein the flywheel has a cover having a dial shape.

Supplementary note 17. The document reading apparatus according to supplementary note 16, further comprising:

a housing in which the document conveying device and the document reading apparatus are installed, wherein a part of the cover is exposed from the housing.

The invention claimed is:

1. A document conveying device, comprising:

a conveyance roller which conveys a document that is attached to a conveyance roller shaft;

a flywheel connected to the conveyance roller shaft;

a flywheel gear attached to the flywheel; and a conveyance roller shaft gear that is attached to the conveyance roller shaft and engages with the flywheel gear, wherein the number of the teeth of the conveyance roller shaft gear is greater than the number of the teeth of the flywheel gear.

2. The document conveying device according to claim 1, wherein inertia moment of the flywheel is larger than the inertia moment of the conveyance roller.

3. The document conveying device according to claim 1, wherein the flywheel gear and the conveyance roller shaft gear are tapered gears.

4. The document conveying device according to claim 1, wherein the flywheel gear and the conveyance roller shaft gear are scissors gears.

5. The document conveying device according to claim 1, further comprising:

a load mechanism which consumes a rotational energy of the flywheel.

6. The document conveying device according to claim 5, wherein the load mechanism is a fin for stifling the surrounding air.

7. The document conveying device according to claim 1, wherein the flywheel has a cover having a dial shape.

8. A document reading apparatus, comprising:

a document conveying device which includes:

a conveyance roller which conveys a document that is attached to a conveyance roller shaft, a flywheel connected to the conveyance roller shaft, a flywheel gear attached to the flywheel, and a conveyance roller shaft gear that is attached to the conveyance roller shaft and engages with the flywheel gear; and a reading device which reads the conveyed document, wherein the number of the teeth of the conveyance roller shaft gear is greater than the number of the teeth of the flywheel gear.

9. The document reading apparatus according to claim 8, wherein the inertia moment of the flywheel is larger than the inertia moment of the conveyance roller.

10. The document reading apparatus according to claim 8, wherein the flywheel gear and the conveyance roller shaft gear are tapered gears.

11. The document reading apparatus according to claim 8, wherein the flywheel gear and the conveyance roller shaft gear are scissors gears.

12. The document reading apparatus according to claim 8, further comprising:

a load mechanism which consumes a rotational energy of the flywheel.

13. The document reading apparatus according to claim 12, wherein the load mechanism is a fin for stifling the surrounding air.

14. The document reading apparatus according to claim 8, wherein the flywheel has a cover having a dial shape.

15. The document reading apparatus according to claim 14, further comprising:

a housing in which the document conveying device and the document reading apparatus are installed, wherein a part of the cover is exposed from the housing.

* * * * *

UNITED STATES PATENT AND TRADEMARK OFFICE

CERTIFICATE OF CORRECTION

PATENT NO. : 8,446,650 B2
APPLICATION NO. : 12/772727
DATED : May 21, 2013
INVENTOR(S) : Toru Uchida, Yasukazu Nagura and Atsushi Uematsu It is certified that error appears in the above-identified patent and that said Letters Patent is hereby corrected as shown below:

Title Page, Item (54) and in the Specification, Column 1, Line 2, (Title): Delete "APPARATUS" and insert -- APPARATUS USING --

In the Claims

Column 10, Line 5, Claim 6, delete "stifling" and insert -- stirring --

Column 10, Line 39, Claim 14, delete "stifling" and insert -- stirring --

Signed and Sealed this
Twenty-first Day of October, 2014

Michelle K. Lee

Michelle K. Lee
*Deputy Director of the United States Patent and Trademark Office*